United States Patent [19]

Phillips

[11] Patent Number: 4,542,551

[45] Date of Patent: Sep. 24, 1985

[54] ROTARY FLOOR MAINTENANCE DEVICE

[75] Inventor: Paul E. Phillips, Whitehall, Mich.

[73] Assignee: McGraw-Edison Company, Rolling Meadows, Ill.

[21] Appl. No.: 537,736

[22] Filed: Sep. 30, 1983

[51] Int. Cl.[4] ..... A47L 11/14

[52] U.S. Cl. ..... 15/49 R; 51/177; 200/157

[58] Field of Search ..... 15/49 R, 49 C, 50 R, 15/50 C, 98, 385, 28; 51/170 T, 177; 200/157; 340/679

[56] References Cited

U.S. PATENT DOCUMENTS

| | | | |
|---|---|---|---|
| 1,872,602 | 8/1932 | Olsen | 15/50 R |
| 2,727,262 | 12/1955 | Gerber | 15/49 R |
| 3,087,078 | 4/1963 | Brown | 15/49 R X |
| 3,412,415 | 11/1968 | Brab | 15/50 R |
| 3,731,334 | 5/1973 | Carbonell | 15/50 R |
| 4,097,950 | 4/1978 | Satterfield | 15/49 R |
| 4,137,590 | 2/1979 | Brown | 15/50 R |
| 4,219,898 | 9/1980 | Presby | 15/49 R |
| 4,333,095 | 6/1982 | Silva | 340/679 |
| 4,435,870 | 3/1984 | Tucker et al. | 15/98 |

FOREIGN PATENT DOCUMENTS

| | | | |
|---|---|---|---|
| 565557 | 12/1932 | Fed. Rep. of Germany | 15/49 R |
| 676525 | 11/1929 | France | 15/49 R |
| 621307 | 6/1961 | Italy | 15/49 R |

*Primary Examiner*—Edward L. Roberts

*Attorney, Agent, or Firm*—Jon C. Gealow; John S. Paniaguas; James A. Gabala

[57] ABSTRACT

A rotary floor maintenance device having, a motor support base with at least one central aperture, an electric motor having a shaft perpendicular to the motor base through the aperture, and a motor adapter directly coupled to the motor shaft for rotation therewith. The motor adapter has a generally annular flange area and central aperature for receiving the motor shaft. A rotary floor engaging tool has at least one aperture adapted to receive the flange of the motor adapter, to be rotated therewith. The motor support base contains notches along the inner periphery of the central aperture for draining accumulated liquids. Also disclosed is a safety interlock switch to prevent inadvertant operation of the machine.

2 Claims, 11 Drawing Figures

ROTARY FLOOR MAINTENANCE DEVICE

TECHNICAL FIELD

The present invention relates to a rotary floor maintenance device particularly a scrubber/polisher.

BACKGROUND OF THE INVENTION

Conventional rotary floor maintenance devices have used gear boxes, belt drives and the like to couple the motor shaft to the rotary brush. Examples of conventional rotary floor maintenance devices are disclosed in the following U.S. Pat. Nos. 1,485,680 to Hughes; 1,588,157 to Beach; 2,079,946 to Myers; 3,412,415 to Brab; 4,330,897 to Tucker; 4,360,939 to Krumm; and 4,365,377 to Todd.

Rotary floor maintenance devices with gear boxes are relatively noisy, and require periodic lubrication. Because of the noise, machines of this type are often distracting when operated during normal working hours in a business environment. The problem becomes particularly acute in hospitals where the permissible noise level is generally limited to 65 db.

Gaudry in U.S. Pat. No. 3,469,470 attempted to reduce the noise level of gear boxes for rotary floor maintenance devices by replacing metal gears with gears made of synthetic resin materials, such as nylon, acetate, polycarbonate, or phenolic thermoplastic resins. Although noise levels are reduced by the use of synthetic resin gears, such gears are not as durable as metal gears. Also, the use of a gear box, whether the gears be made of metal or synthetic resin, reduces the overall efficiency of the rotary floor maintenance device.

Gear boxes are generally required in order to supply high torque at low speed to the rotary brushes. Without a gear box or the like, the electrical current which would be required to operate a floor maintenance device motor at sufficient torque and relatively low speed would exceed the 20 amp trip current of the circuit breaker protecting the circuit from which the floor maintenance device is being supplied electric power.

Another solution is to use an electric motor having greater torque at lower speeds. However, this solution results in an increase in the physical size of the motor, particularly the height. Since the motors are typically mounted directly on top of the rotary brush skirt housing, any increase in motor size also increases the height of the machine operating head. Since it is desirable to use rotary floor maintenance devices under furniture and cabinet ledges, it is necessary to keep the overall height of the machine operating head as low as possible. Therefore increasing the overall height of the machine operating head detracts from the general utility and desirability of the machine. Various arrangements for reducing the height of the operating head have been proposed and used. For instance, U.S. Pat. No. 2,079,946 to Myers discloses a construction whereby the motor is mounted to the rear of the operating head. U.S. Pat. No. 3,518,712 to Berger discloses a motor mounted on the handle. Although both of the aforementioned designs reduce the overall height of the operating head, both relocate the overall center of gravity of the machine in a way which causes the overall stability of the machine to be reduced.

Another problem which has been encountered with conventional machines is that liquid is splashed into the motor housing and accumulates therein. This can be a personnel safety hazard, as well as being destructive to the motor. Despite the adverse consequences of liquid accumulation in the motor housing, the design of a motor support structure which will allow drainage appears not to have been previously attempted. This feature is particularly important when the rotary floor maintenance device is used in a scrubbing mode. In this mode water and detergent solution may be splashed into the motor housing.

Control of conventional rotary floor maintenance devices can easily be lost if they are started inadvertantly. Such a runaway device can potentially cause injury and damage. One way to prevent inadvertant operation is to put a safety interlock in the handle, thereby requiring two independent actions by an operator, rather than one, to operate the machine. In this way, the likelihood of inadvertant operation is greatly reduced. U.S. Pat. No. 3,412,415 to Brab descloses one type of safety interlock. Brab utilizes a bar linkage to actuate a microswitch which controls the energization of the machine. One member, connected to a safety interlock actuator, defeats a stop on a bar linkage when depressed, to allow the microswitch to be revolved and consequently actuated by a linkage member. Linkage devices such as the one disclosed in the Brab patent, because of the journalled connection of linkage members, require periodic maintenance including lubrication. This may require disassembly of the interlock system. Once disassembled, maintenance personnel may decide to defeat the interlock to preclude the need for further periodic maintenance. Also, three and four bar linkages, such as the one disclosed by Brab, require coplanar alignment for proper operation. Improper and forceful actuation of the interlock can cause misalignment and therefore the need for additional maintenance.

SUMMARY OF THE INVENTION

In accordance with the present invention, a compact rotary floor maintenance device is disclosed which comprises an operating head or motor support base having at least one aperture therein, a electric motor having a shaft, a motor with its shaft disposed generally perpendicular to said motor support base, with the shaft extending through the motor support base aperture. A motor adapter directly coupled to the motor shaft for rotation therewith has a generally annular flange and a central aperture for receiving the motor shaft. A rotary brush contact means, for contacting a floor surface, has at least one aperture adapted to receive the flange of said motor adapter. Unlike conventional rotary floor maintenance devices, the rotary brush contact means is directly driven by the electric motor. Thus, noisy gear boxes and the like are eliminated. This is particularly useful for rotary floor maintenance devices which are used in hospitals where the maximum acceptable noise level is generally limited to 65 db.

In one embodiment of this invention, the electric motor is mounted vertically on the motor support base. Drainage notches are provided in the motor support base to allow accumulated liquids to drain away from the electric motor. This is a useful feature when a rotary floor maintenance device is being used as a scrubber. During this mode of operation, it is possible for water and detergent solution to splash into the motor housing. An accumulation of water and detergent solution could present a personnel safety hazard to the operator as well as having a debilitating effect on the motor. Thus, the notches located in the motor support base will preclude water from accumulating in the motor housing, thereby eliminating or at least reducing these problems.

An electric motor control means is provided which allows the speed of the motor to be varied in infinitesimal steps at the perogative of the operator for various floor maintenance operations. A knob conveniently located on the motor housing allows the operator to vary the motor speed to suit the operating mode or surface finish desired. Faster motor speeds are generally used for polishing whereas slower speeds are generally used for scrubbing.

A further feature of this invention is the provision of a safety switch in the handle which prevents the motor from starting until the switch is depressed. This safety feature prevents inadvertent operation of the rotary floor maintenance device. This feature is particularly important for floor maintenance devices with rotary brushes since they can go out of control if not properly held by the handle.

Numerous other advantages and features of the present invention will become readily apparent from the following description of the invention and its various embodiments, from the claims, and from the accompanying drawings wherein:

DETAILED DESCRIPTION OF THE INVENTION

Figure 3:
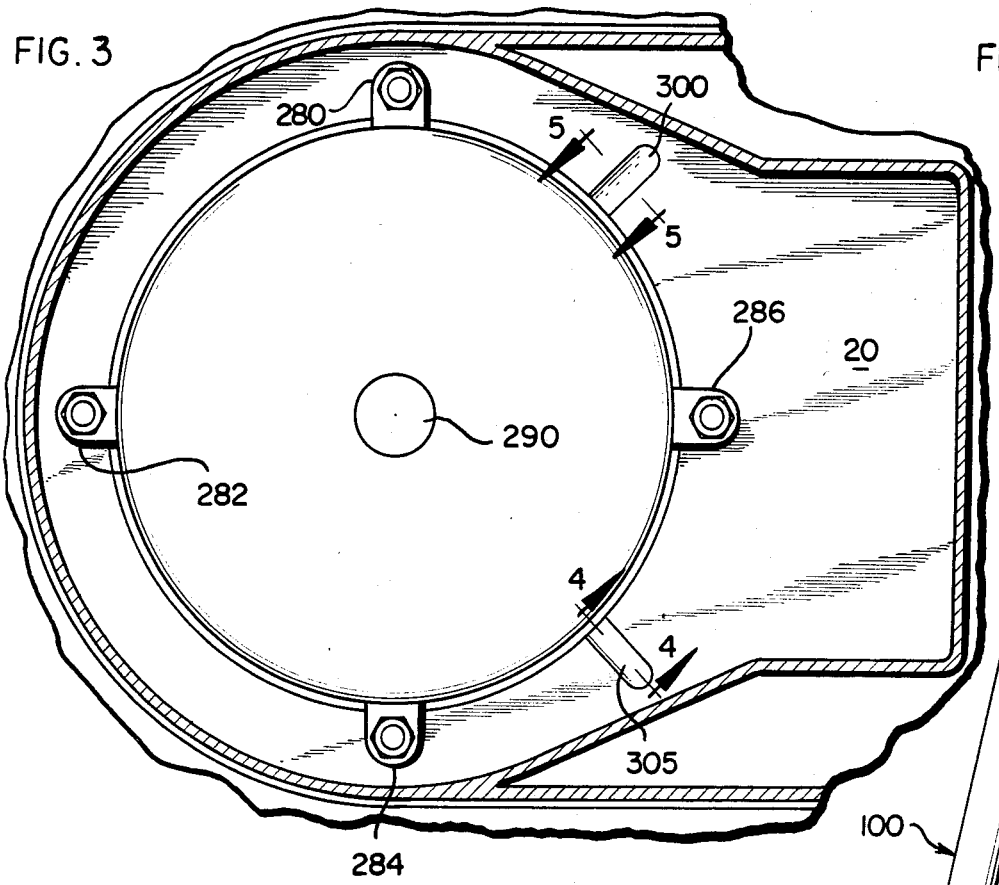
FIG. 3 is a top view of the motor support base as viewed along line 3—3 in FIG. 2.

While this invention is susceptible of embodiment in many different forms, there is shown in the drawings, which will herein be described in detail, preferred embodiment of the invention. It should be understood however, that the present disclosure is to be considered as an exemplification of the principles of the invention and is not intended to limit the invention to the specific embodiment illustrated.

Figure 1:
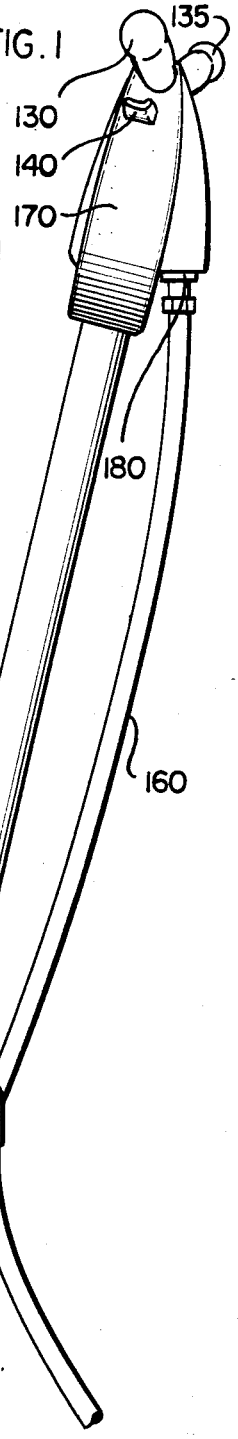
FIG. 1 is a perspective view of a rotary floor maintenance device.

Referring now to the drawings and to FIG. 1, in particular, there is shown a perspective view of a rotary floor maintenance device 10 having an operating head or motor support base 20, a electric motor housing 21, and a rotary brush means 40. An electric motor 22 (FIG. 2) is mounted vertically in motor housing 21 which is provided with a cover 60. The motor is mounted on motor support base 20. Motor housing vents 70, in housing 21 provide ventilation for cooling of the motor. A rotary brush skirt 80 is provided under motor support base 20 to reduce liquid splashing caused by the rotary brush means 40. The rotary floor maintenance device 10 is support by either the rotary brush means 40, or by two wheels 90 and 95 which are mounted on motor support base 20.

Figures 6, 7:
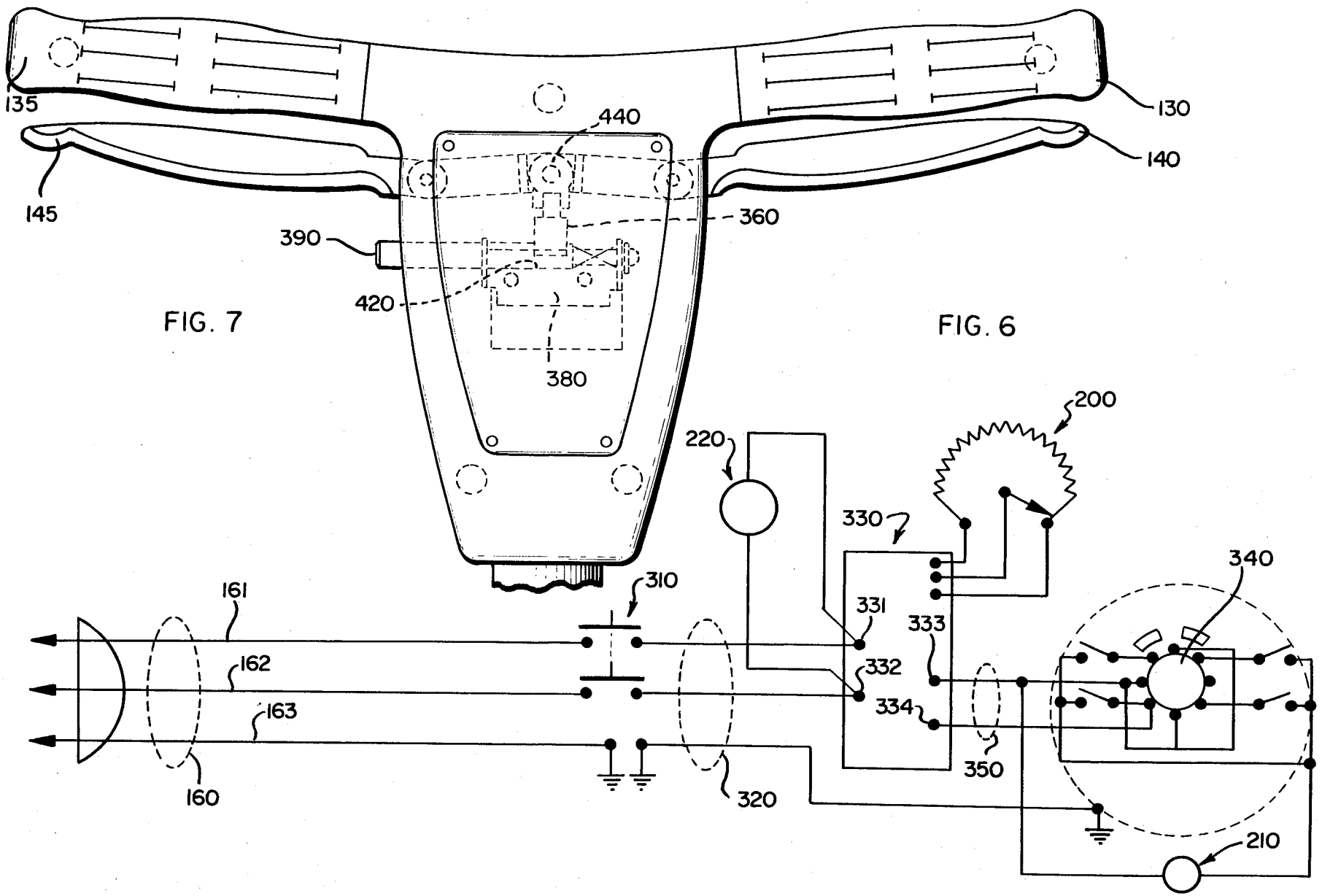
FIG. 6 is an electrical schematic diagram.
FIG. 7 is a front view of the handle in the off position.

An adjustable operator handle 100 is attached at one end to motor support base 20 and is used to guide the rotary floor maintenance device 10. Handle attachment members 110 and 115 are rigidly attached to the motor support base. Adjustment of operator handle 100 is accomplished by loosening a handle clamp 120, raising or lowering operator handle 100 to the position desired by operator and subsequently retightening handle clamp 120. Two pistol grips 130 and 135 and two hand operated levers 140 and 145 are located at the free end of the operator handle 100. The rotary floor maintenance device 10 cannot be started until a safety interlock switch 390, shown in FIG. 6, is depressed. This feature prevents inadvertent operation of the rotary floor maintenance device 10. Once safety interlock switch 390 is depressed the handle pistol grips 130 and 135 and hand operated levers 140 and 145 respectively, can be squeezed together. This will keep the machine running as long as the handle pistol grips 130 and 135 and the hand operator levers 140 and 145 are held together. Once released, the electric power to the machine will be disconnected and the rotary brush contact means will coast to a stop.

Electric power is supplied to the machine via electric supply cord 160 which enters a switch housing 170 through aperture 180 and is connected to the line side of switch 310. Handle cord 320 is routed down through the handle 100 and passes through aperture 180 near the bottom of handle 100 to be connected to the motor. Electrical supply cord 320 is routed into an aperture (not shown) in the motor housing 21 to the electrical motor 22 (FIG. 2) via electrical cord 350.

Figure 2:
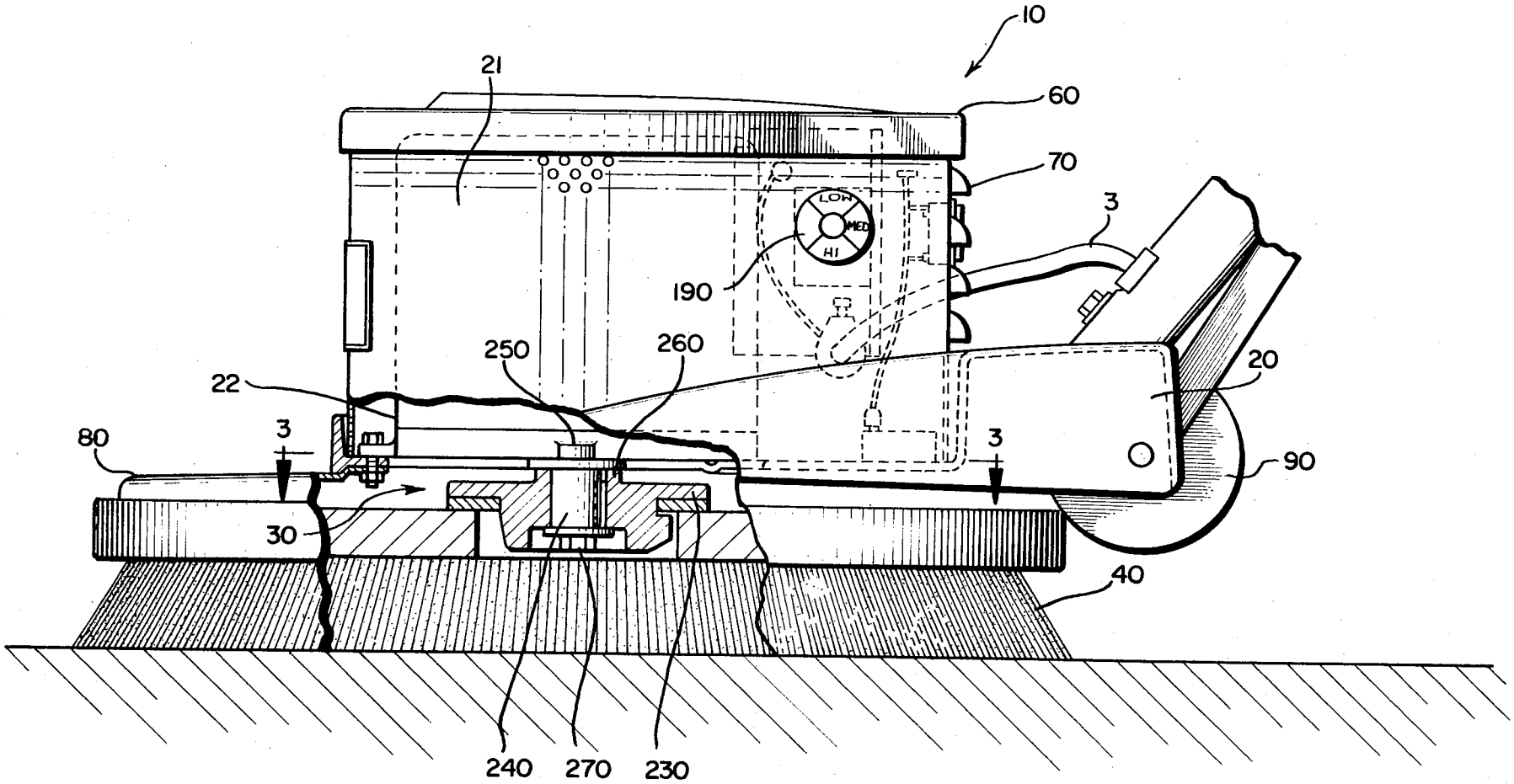
FIG. 2 is a side view of the motor housing with a partial section illustrating the motor adapter.

The electrical drive motor 22 (FIG. 2) is of the permanent magnet type. Those skilled in the art know that permanent magnet motors are direct current motors. It is also known that one means of varying the speed of a direct current motor is by inserting a variable resistance in the armature circuit. The speed of the rotary floor maintenance device 10 is controlled by a speed control knob 190 located on the motor housing 21, as shown in FIG. 2. The speed control knob 190 controls a potentiometer 200, shown schematically in FIG. 6 which is located inside the motor housing 21. In one commercial embodiment of this invention, an Imperial Electric Company permanent magnet type electric motor is used. The Imperial Electric Company motor has the following specifications: 180 frame, force ventilated, 1.25 horsepower at 450 rpm, continuous duty, rated torque 15 lb/ft. The motor is of the pancake design with a height to diameter ratio of less than one. In one embodiment, the motor used had a height of about $6\frac{7}{8}$ inches and a diameter of about 9 inches. When this motor is mounted on the motor support base 20 with its shaft extending vertical downward, the overall height of the motor is less than other motors, not of the pancake design, with similar capabilities. Keeping the overall height of the operating head of the machine as low as possible, increases the utility and desirability of the rotary floor maintenance device 10. The lower height permits the operator head to pass under furniture and under cabinet ledges, thereby making the machine more useful and desirable.

Permanent magnet motors utilize brushes and a commutator to supply the direct current to the armature winding. The brushes are usually spring loaded against the commutator to maintain good electrical contact with the commutator even as the brushes become shorter due to wear. Worn-out brushes can cause scoring of the commutator and arcing which can seriously damage the motor. Consequently, brushes must be periodically replaced, preferrably near the end of their useful life. Brushes should be replaced at times convenient to the operator. A brush indicator light 210 is provided to apprise the operator when the brushes need replacement, without having to disassemble the rotary floor maintenance device 10 to inspect the brushes. In this way the replacement of the motor brushes can be scheduled so as to preclude the need to replace the brushes at an inconvenient time. Details of the brush wear indicator light are described in Assignee's copending U.S. patent application; Ser. No. 460,067; filed Jan. 21, 1983, which is incorporated herein by this reference.

Ventilation of the drive motor is accomplished by providing an alternating current motor driven fan 220 shown schematically in FIG. 6 which is connected to run when the permanent magnet drive motor is running. As previously set forth, ventilation louvers 70 (FIG. 2) are provided on the rear of motor housing 21 for cooling air floor.

FIG. 2 illustrates a partial side view of a rotary floor maintenance device 10 with a partial cut-away section to illustrate a motor adapter 30. The motor adapter 30 has a generally annular flange portion 230 and a central aperture 240 which is adapted to receive motor shaft 250, and is keyed to motor shaft 250 such that the motor adapter 30 rotates with motor shaft 250. While the motor adapter 30 can be fastened to the motor shaft 250 by various means, FIG. 2 shows the use of a bolt 270 screwed into a threaded aperture in the end of motor shaft 250. The rotary brush means 40 includes an aperture (not shown) which is adapted to fit over the annular flange portion 230 of the motor adapter 30 and to be twisted and locked into place. The method of fastening the rotary brush means 40 is conventional.

Figure 4:
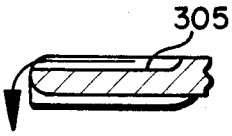
FIG. 4 is a sectional view of a drainage notch as viewed along line 4—4 in FIG. 3.
Figure 5:
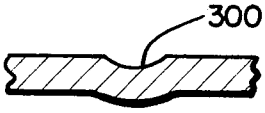
FIG. 5 is a sectional view of a drainage notch as viewed along line 5—5 in FIG. 3.
Figure 5:
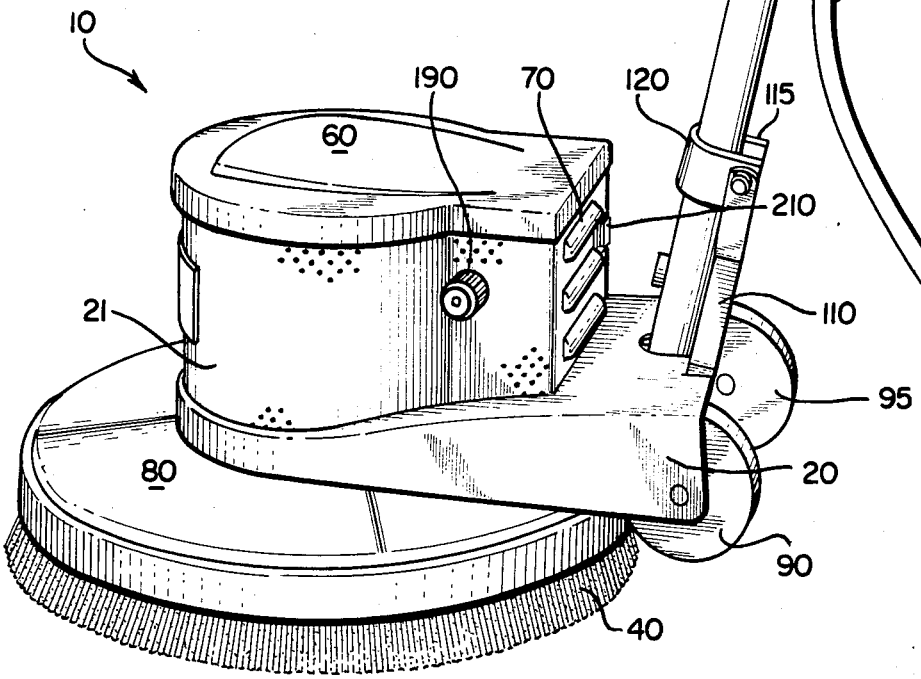

FIG. 3 is a top view of the motor support base 20. The electric drive motor 22 (FIG. 2) is secured to the motor support base by suitable fastening means engaged in mounting holes 280, 282, 284 and 286. The drive motor is to be mounted such that the drive motor shaft 250 (FIG. 2) extends through the center aperture 290 in the motor support base 20. Notches 300 and 305 located along the inner periphery of aperture 290 allow water splashed up into the motor housing 21 to drain back onto the rotary brush means 40. This prevents accumulation of water in the motor housing 21. The drainage notches are further illustrated in section views in FIG. 4 and in FIG. 5.

FIG. 6 illustrates the schematic control circuit for the drive motor. AC power is supplied to the motor by an electrical cord 160. A three conductor electrical supply cord 160 is used. One end of the cord is connected to a conventional three-terminal plug. On the other end conductors 161 and 162 whcih are to be energized by 120 volt AC power are connected to switch 310. Conductor 163 is a safety ground. Switch 310 is a double-pole, single-throw momentary switch, which is normally open. The contacts of switch 310 must be closed to operate the machine. The switch is of the dead-man type, in that the contacts of switch 310 must be held closed by switch actuator means such as pistol grips 130 and 135 and handle operator levers 140 and 145, to keep the machine running. Once the switch actuator means is released, such as by releasing handle operator levers 140 and 145, the machine stops. A handle cord 320 connects switch contacts 310 to terminals 331 and 332 of a speed controller means 330. The speed controller means 330 has at least seven terminals and contains a means for converting AC voltage to DC voltage. The DC outlet terminals 333 and 334 of the speed controller means 330 are connected to armature 340 of the drive motor.

In one embodiment, the speed controller 330 is basically a solid state, SCR controlled full-wave rectifier. AC electrical power at 120 volts is supplied to the controller 330 and a DC output voltage is supplied to the electric drive motor. The firing angle of the SCR is controlled by potentiometer 200 to produce the DC output voltage required to provide the desired speed of the drive motor. The potentiometer 200 is adjusted manually by the operator. Other conventional means for varying the speed of a DC motor are known to those skilled in the art. Also, other conventional means are available to rectify AC voltage so as to provide DC voltage. The aforementioned speed controller 330 is conventional, with Dart Controls, Inc. being one of the manufacturers thereof.

Figure 8:
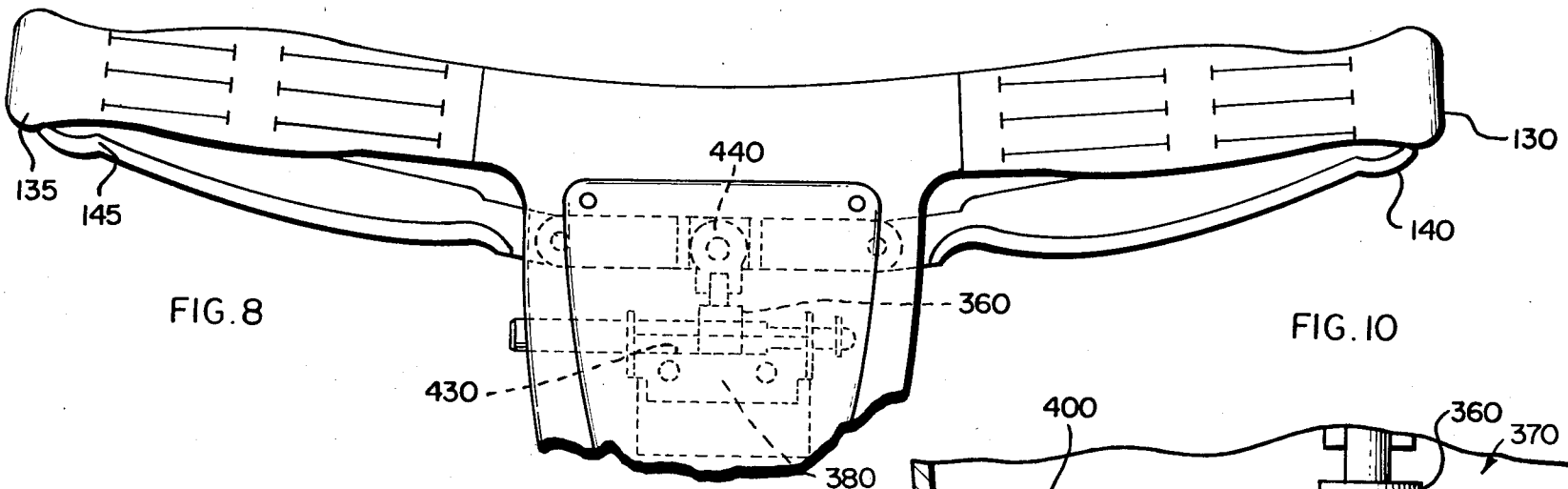
FIG. 8 is a front view of the handle in the on position.
Figure 10:
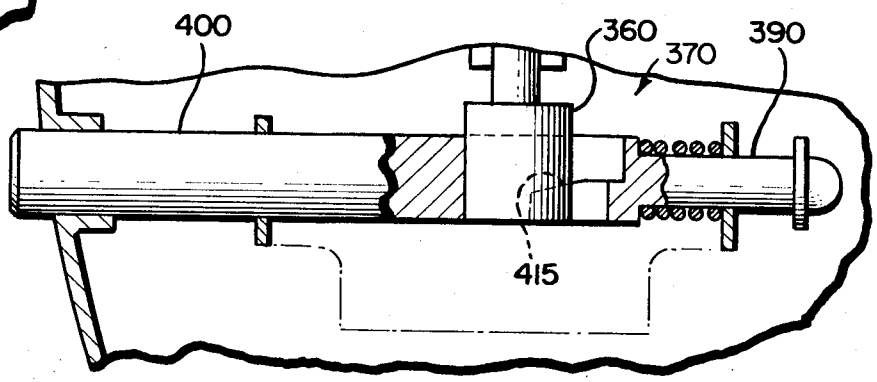
FIG. 10 is a side view in section of the safety interlock mechanism in the unlocked position.
Figure 11:
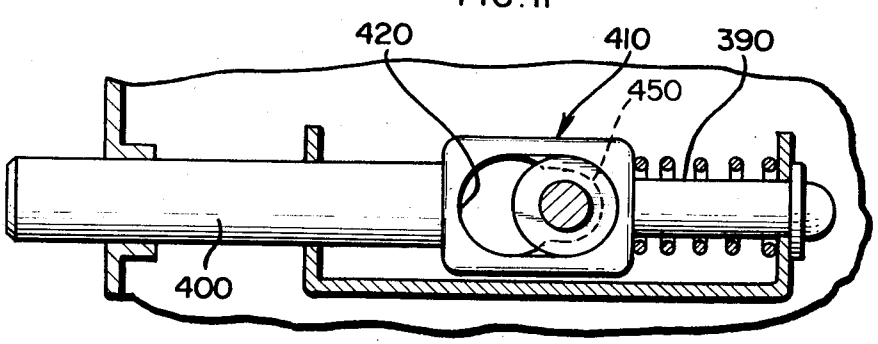
FIG. 11 is a top view of the safety interlock mechanism.
Figure 9:
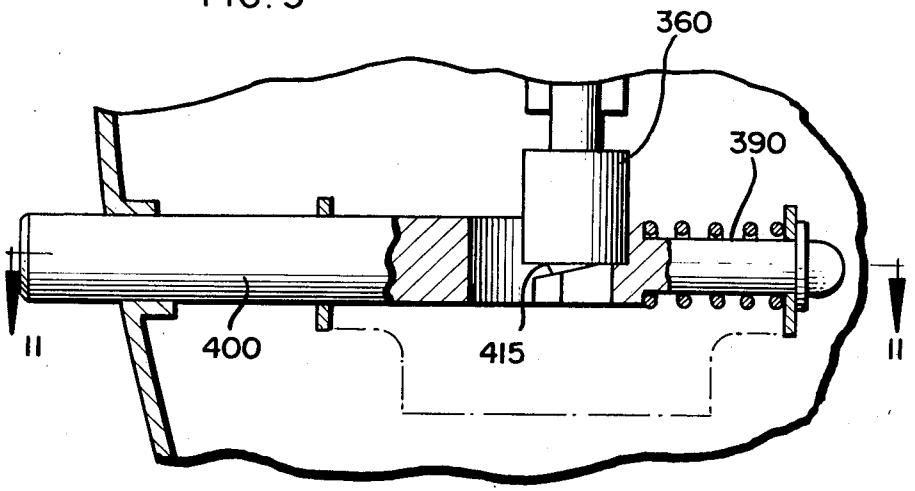
FIG. 9 is a side view in section of the safety interlock mechanism in the locked position.

FIG. 7 illustrates the safety interlock mechanism in the blocking or machine not running position. The safety interlock system is comprised of a microswitch adapter 360, a mechanical switch interlock 370 and a bracket 380. The mechanical switch interlock 370 is comprised of first cylindrical portion 390, a second cylindrical portion 400 and a rectangular portion 410 having an aperture 420 therein (FIG. 11). Aperture 420 is in the shape of overlapping cylinders of different diameters. The larger diameter cylinder of aperture 420 is adapted to receive microswitch adapter 360. In one embodiment the rectangular portion 410 of mechanical switch interlock 370 is carried by a flat portion 430 of bracket 380. Microswitch adapter 360 is carried on surface 415 of mechanical switch interlock 370. As mechanical switch interlock 370 is moved in a direction parallel to its axis of rotation, the larger portion at aperture 420 is positioned under microswitch adapter 360. At this point compression of the handle pistol grips 130 and 135, and operated levers 140 and 145 respectively force a member 440 in a downward direction. When the safety interlock switch 370 is depressed, the larger portion of aperture 420 will be positioned under the first cylindrical portion of microswitch adapter 360 so as to allow the microswitch adapter to move downward. The cylindrical portion of microswitch adapter 360 contains an aperture 450 which is adapted to receive a microswitch actuator (not shown). When microswitch adapter 360 travels downward, it engages the microswitch actuator thereby closing the microswitch contacts. When the safety switch interlock is not depressed, the smaller portion of the first cylindrical portion 390 of microswitch adapter 360, prevents downward movement, and hence inadvertant operation of the machine. FIG. 8 illustrates the safety interlock mechanism in the machine running position. FIGS. 9, 10 and 11 further illustrates the safety interlock mechanism. The aforementioned design is akin to a deadbolt type design, and hence contains fewer linkages. In this design coplanar alignment does not need to be as in precise as bar linkages and lubrication will not be need as frequently as with straight bar linkage designs.

I claim:

1. A compact rotary floor maintenance device comprising:

a motor support base having a upper side and lower side and at least one aperture therein;

at least one wheel privotably connected to said motor support base for supporting a portion of the weight of said motor support base relative to a floor;

a high torque electric drive motor disposed on the upper side of said base having a shaft with a free end, and said motor and said shaft being disposed generally perpendicular to said motor support base, and said free end of said shaft extending through said aperture in said motor support base, said electric motor being of a pancake design with the ratio of the height of said motor to the diameter of said motor being less than one;

a motor adapter, directly coupled to the free end of said motor shaft on the lower side of said base for rotation therewith;

a rotary brush means for contacting the surface of said floor, said brush means being directly coupleable to said motor adapter for rotation with said motor adapter and said motor shaft at the same speed as said motor shaft; and means for controlling the speed of said drive motor between a pre-selected high speed and a pre-selected low speed where said motor spins said brush means at sufficiently high torque without streaking the surface of the floor.

2. The compact rotary floor maintenance device of claim 1, wherein said electric motor is of the permanent magnet direct current energized type.

* * * * *